United States Patent [19]

Tamba et al.

[11] Patent Number: 4,662,322

[45] Date of Patent: May 5, 1987

[54] OVERHEAD-VALVE ENGINE

[75] Inventors: Shinichi Tamba, Kakogawa; Hitomi Miyake, Kobe; Noboru Fukui, Kakogawa, all of Japan

[73] Assignee: Kawasaki Jukogyo Kabushiki Kaisha, Tokyo, Japan

[21] Appl. No.: 801,316

[22] Filed: Nov. 25, 1985

[30] Foreign Application Priority Data

Nov. 26, 1984 [JP] Japan ..... 59-249383
Aug. 28, 1985 [JP] Japan ..... 60-190234

[51] Int. Cl.[4] ..... F01M 13/00
[52] U.S. Cl. ..... 123/41.86; 123/196 W
[58] Field of Search ..... 123/41.86, 572–574, 123/90, 61, 96, 62, 196 W

[56] References Cited

U.S. PATENT DOCUMENTS

| | | | |
|---|---|---|---|
| 2,250,200 | 7/1941 | Lowther | 123/574 |
| 3,456,759 | 7/1969 | Henry-Biabaud | 123/41.86 |
| 4,470,389 | 9/1984 | Mitadera et al. | 123/41.86 |
| 4,528,969 | 7/1985 | Senga | 123/573 |
| 4,549,520 | 10/1985 | Tamba et al. | 123/572 |

*Primary Examiner*—William A. Cuchlinski, Jr.
*Attorney, Agent, or Firm*—Leydig, Voit & Mayer

[57] ABSTRACT

An overhead valve engine including a bore for receiving a push rod for actuating a suction valve and a bore for receiving a push rod for actuating a discharge valve. Blowby gas is introduced into one of the bores from a crank chamber and supplied to the other bore via a rocker arm chamber to lubricate the push rods with oil mist in the blowby gas. After lubricating the push rods, the blowby gas is released via the breather gas from the engine.

6 Claims, 5 Drawing Figures

OVERHEAD-VALVE ENGINE

BACKGROUND OF THE INVENTION

This invention relates to overhead-valve (OHV) engines, and more particularly it is concerned with an OHV engine equipped with an improved breather device.

An OHV type cylinder is known which has a suction valve and a discharge valve located on the top surface of the combustion chamber, and an OHV V-type engine is used which comprises a plurality of OHV cylinders arranged in the form of a letter V.

In this type of engine, a camshaft is usually located above the crankshaft near each cylinder, and tappets and push rods for actuating the suction valve and discharge valve are located along an upper portion of each cylinder.

A four-cycle engine including the aforesaid type of engine is provided with means for releasing blowby gas leaking from the surfaces of the cylinders in which pistons are fitted to a crank chamber (an interior space of the crankcase) or a breather device operative to effect ventilation for the crank chamber.

If unattended, the blowby gas would cause an inordinate rise in the pressure in the crank chamber, causing the engine oil to leak. Thus, it is customary to provide a breather device for releasing the blowby gas through a check valve. The blowby gas usually contains non-combusted fuel components which would cause air pollution if released to the atmosphere, so that the blowby gas is usually led to the air cleaner.

Agitation of the oil in the crank chamber usually results in oil mist mingling with the blowby gas. Thus, to avoid air pollution, ejection of white fumes and accumulation of carbon, it has been usual practice to return the blowby gas to the air cleaner after subjecting same to oil/gas separation. In order that the breather device may satisfactorily perform the function of releasing the blowby gas, it is necessary that it be located in an upper portion of the crankcase.

Japanese Utility Model Examined Publication No. 234567/81 discloses one example of the construction of the breather device of an OHV V-type engine of the prior art.

Generally, the breather devices of the OHV V-type engines have each been constructed as an entity separate from the crankcase and mounted in an upper portion of the gear chamber of the crankcase or at one side of the gear chamber which projects from the top of the crankcase. This constructional form has given rise to several problems. One of them is that it is impossible to provide an oil/gas separation chamber of sufficiently large volume to satisfactorily achieve separation of oil from gas. Another problem is that, since various parts are mounted at the bottom of the V-bank (the junction of the upper sides of the cylinders arranged in the form of a letter V), dust and pieces of straw tend to collect therein and difficulty is experienced in performing a cleaning operation.

Proposals have been made to lead the blowby gas to the rocker arm chamber to lubricate the interior thereof and push rods and other parts for actuating the suction and discharge valves by utilizing the oil mist in the blowby gas. However, since the breather device of the prior art makes it necessary to provide an additional passageway or pipe for the gas flowing from the rocker arm chamber to the oil/gas separation chamber, the problem that the engine becomes complex in construction has arisen.

OBJECTS AND SUMMARY OF THE INVENTION

This invention has been developed for the purpose of obviating the aforesaid problems of the prior art. Accordingly, an object of the invention is to provide an OHV engine wherein the breather chamber for effecting separation of oil from gas has a sufficiently large volume to satisfactorily accomplish the object and the bottom of the V-bank is planer so that the dust and pieces of straw collecting therein is reduced in volume and cleaning can be readily performed.

Another object is to provide an OHV engine which is simple in construction and yet high in oil/gas separation performance while enabling lubrication of the rocker arm chamber to be advantageously performed with the separated oil.

Still another object is to provide an OHV engine which eliminates the need to form by machining a separate passageway for the oil returning from the rocker arm chamber and allows a return oil passageway to be formed simultaneously as the cylinder block and cylinder head block are cast by molding.

Outstanding characteristics of the OHV engine provided by the invention to accomplish the aforesaid objects are as follows: the breather chamber for effecting separation of oil from gas is located in a space defined by the V-bank at one side of the camshaft gear, and at least one of the blowby gas passageway extending from the crank chamber to the rocker arm chamber and the blowby gas passageway extending from the rocker arm chamber to the breather chamber is constituted by a push rod receiving bore, so that blowby gas can be led from the crank chamber to the breather chamber after being introduced into the rocker arm chamber.

DESCRIPTION OF THE PREFERRED EMBODIMENTS

Figure 1:
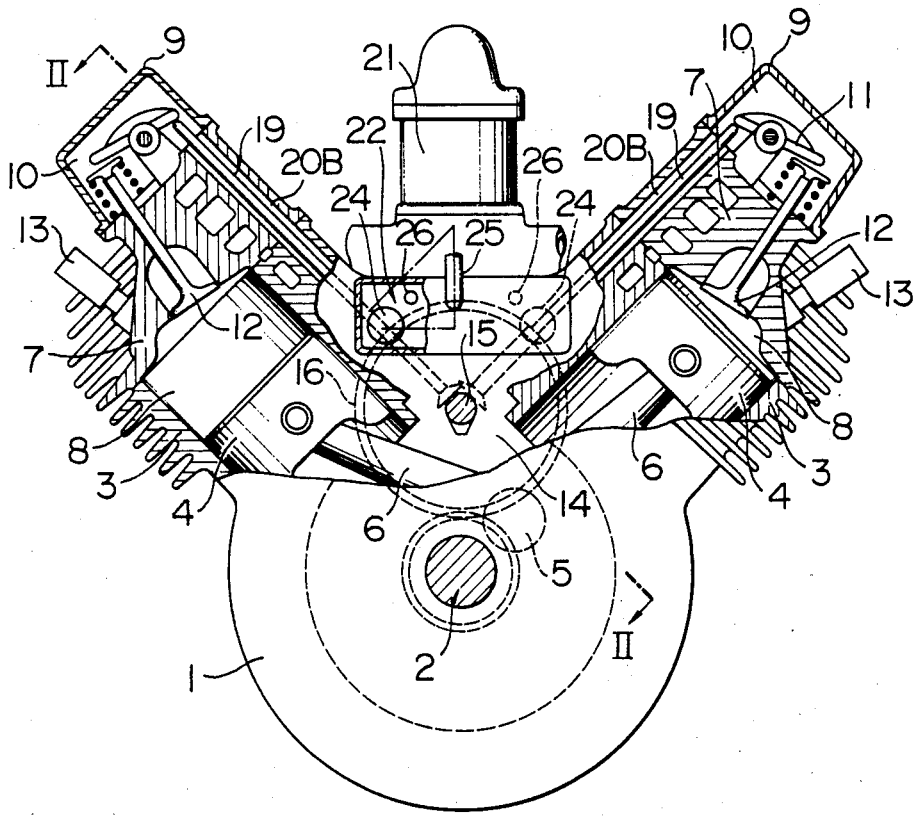
FIG. 1 is a front view, with certain parts being cut out, of the OHV engine comprising one embodiment of the invention.
Figure 2:
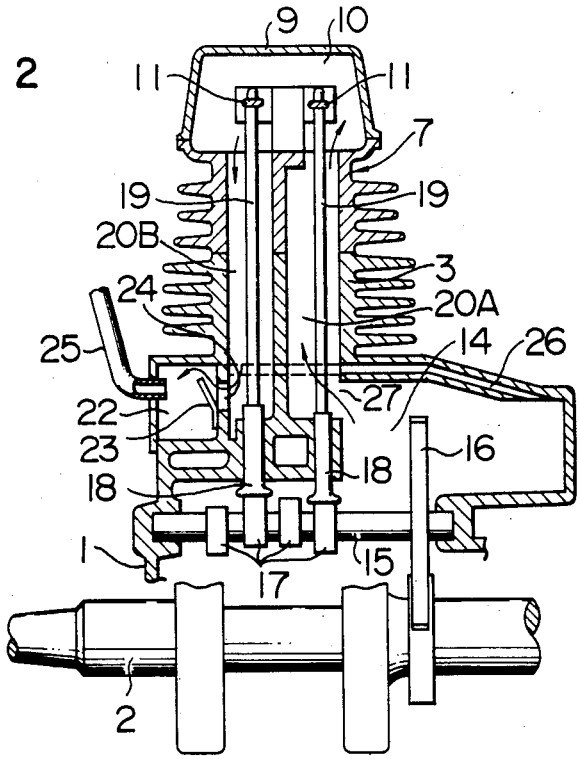
FIG. 2 is a sectional view taken along the line II—II in FIG. 1.

FIG. 1 shows one constructional form of the breather device in a vertical section which is perpendicular to the crankshaft; and FIG. 2 shows a cross section taken along the line II—II in FIG. 1. The first embodiment of the invention will be described by referring to these figures.

In FIGS. 1 and 2, a crankcase 1 is supported by a crankshaft 2 and has a pair of cylinders 3 arranged thereon in the form of a letter V to form a predetermined angle (90 degrees, for example) therebetween.

Each cylinder 3 has a piston 4 fitted therein and connected to a crankpin 5 of the crankshaft 2 by a connecting rod 6. Each cylinder 3 has, secured to its upper end, a cylinder head 7 cooperating with the piston 4 to define therebetween a combustion chamber 8. Secured to the top of each cylinder head 7 is a head cover 9 defining therein a rocker arm chamber 10 having a pair of rocker arms 11 for actuating an intake valve 12 and a exhaust valve, not shown, located in each cylinder head 7. The reference numeral 13 designates ignition plugs.

A camshaft 15 is located in a crank chamber 14 defined in the crankcase 1 in a position above the crankshaft 2 and driven through a camshaft gear 16 by the crankshaft 2 for rotation at a velocity which is one-half that of the crankshaft 2. The camshaft 15 is formed with four cams 17 each for actuating one of the intake valve and exhaust valve of the two cylinders 3.

A tappet 18 and a push rod 19 are connected between each cam 17 and each rocker arm 11. Each tappet 18 is supported for reciprocatory movement in the crankcase 1, and the two push rods 19 extend through push rod receiving bores 20A and 20B respectively formed at the upper side of each cylinder 3 and each cylinder head 7 and each abut against one end of one of the rocker arms 11.

The reference numeral 21 shown in FIG. 1 designates a suction system comprising an air cleaner, carburetor, etc., located in the V-bank.

A breather chamber 22 formed integrally with the crankcase 1 for separating oil from gas is located in a space in the V-bank located at one side of the camshaft gear 16 of the camshaft 15 or in a space defined by the V-bank substantially corresponding to a side surface of the camshaft gear 16 as seen in a direction parallel to the camshaft 2.

The breather chamber 22 is constructed such that, as seen in FIGS. 1 and 2, it is located adjacent the push rod receiving bores 20B and maintained in communication therewith via a gas inlet port 24 formed at a wall separating the chamber 22 from the bores 20B and provided with a check valve 23.

A breather pipe 25 communicated with the air cleaner, not shown, is connected to an outer wall of the breather chamber 22, and oil return passageways 26 are formed between the breather chamber 22 and the crank chamber 14.

The push rod receiving bores 20A remote from the breather chamber 22, one of which is shown on the right side of the push rod receiving bore 20B in FIG. 2, are maintained at their lower portions in communication with the crankcase 1 via a port 27, and the push rod receiving bores 20A and 20B of each cylinder 3 open at their upper ends in the respective rocker arm chamber 10. Thus, the blowby gas in the crank chamber 14 is introduced via the port 27 and the push rod receiving bores 20A on the right side of the push rod receiving bores 20B in the cylinders 3 into the rocker arm chambers 10 as indicated by an arrow in FIG. 2 so as to lubricate the parts in the rocker arm chambers 10 with the oil contained in the blowby gas. Then, the blowby gas is led through the push rod receiving bores 20B on the left side of the push rod receiving bores 20B in the cylinders 3 and released via the inlet port 24 into the breather chamber 22.

The check valve 23 located in the gas inlet port 24 is constructed such that it allows an inflow of gas into the breather chamber 22 but blocks an outflow of gas from the breather chamber 22 to the push rod receiving bore 20B. Thus, when the internal pressure of the crank chamber 14 exceeds a predetermined level, the check valve 23 is brought to an open position to introduce the blowby gas into the breather chamber 22.

The OHV engine shown in FIGS. 1 and 2 has been described as being arranged in such a manner that the crankshaft 2 is disposed horizontally. However, the invention is not limited to this specific position of the OHV engine, and the engine shown may be used in a position in which the crankshaft 2 is disposed in a vertical position with respect to the horizontal or in an inclined position deviating from the vertical position. When the engine is used in the vertical or substantially vertical position, the engine may be constructed such that the breather chamber 22 is disposed in an upper portion thereof and the camshaft gear 16 of the camshaft 15 is in a lower portion thereof, so that the breather chamber 22 will be located in an uppermost portion of the crank chamber 14 to ensure that the oil (lubricant) is positively separated from the gas.

The embodiment of the invention shown and described hereinabove can achieve the following effects:

(1) The provision of the breather chamber 22, which is integral with the crankcase 1, in a space in the V-bank at one side of the camshaft gear 16 of the camshaft 15 enables the breather chamber 22 of sufficiently large volume to be readily formed without requiring enlargement of the gear chamber or provision of a projection to the crankcase 1, thereby permitting oil/gas separation to be positively effected. The bottom portion of the V-bank or the junction of the upper sides of the two cylinders 3 can be rendered unobtrusive in shape and smooth in construction, so that the volume of dust or pieces of straw collecting therein can be reduced and cleaning can be readily performed.

(2) The arrangement whereby the blowby gas in the crank chamber 14 is led into the rocker arm chambers 10 before it is introduced into the breather chamber 22 and the push rod receiving bores 20A and 20B already formed are utilized as gas passageways permits the blowby gas containing a large volume of oil to be supplied to the rocker arm chambers 10 without any trouble. This makes it possible to lubricate the rocker arm chambers 10 satisfactorily without providing separate and independent lubricant passageways.

Separation of oil from gas takes place to a certain extent in the rocker arm chamber 10. This enables oil/gas separation to be positively effected in the breather chamber 22, thereby reducing the consumption of lubricant.

The use of the push rod receiving bores 20A and 20B as gas passageways eliminates the need to provide gas passageways separately and permits lubrication of the tappets 18 and push rods 19 to be positively effected.

(3) When the OHV engine is used as a vertical engine in which the crankshaft 2 is located in a vertical position, the breather chamber 22 can be located in the uppermost portion of the crank chamber 14, thereby enabling oil to be positively separated from gas.

The OHV engine shown in FIGS. 1 and 2 is of one pin type in which the two connecting rods 6 are connected to the one crankpin 5. However, the invention is not limited to this specific form of OHV engine, and the engine may be of two pin type in which each connecting rod is connected to one of the two pins. The bores for receiving the push rods which are shown as being formed integrally with the cylinders and cylinder heads may be replaced by pipes which are separate from and independent of the cylinders and cylinder heads.

Another embodiment of the OHV engine in conformity with the invention will be described by referring to FIGS. 3, 4 and 5. This embodiment is distinct from the embodiment shown in FIGS. 1 and 2 in that it is of a vertical type in which the crankshaft is located in a vertical position and the push rods are located in a horizontal position.

Figure 3:
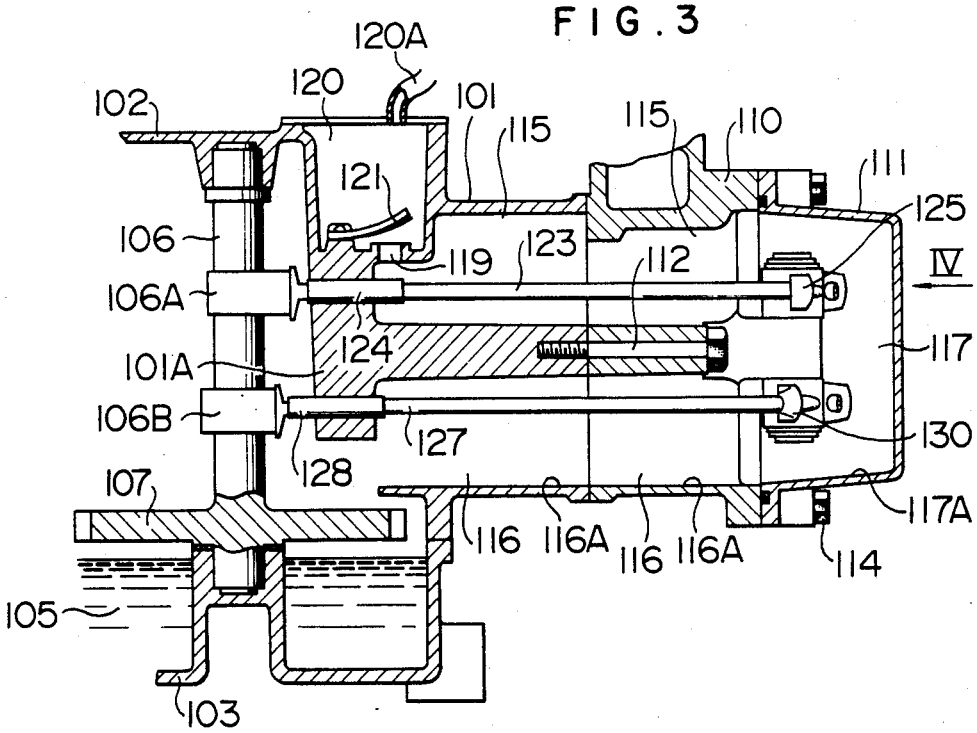
FIG. 3 is a sectional view, taken along the line III—III in FIG. 4, of the OHV engine comprising another embodiment.

Referring to FIG. 3, a cylinder block 101 is formed integrally with a crankcase 102 having a crankcase cover 103 secured to a lower open end face thereof and a vertical camshaft 106 located in a crank chamber 105. The camshaft 106 having a camshaft gear 107 integral therewith is rotatably supported at its upper and lower end by the crankcase 102 and crankcase cover 103 respectively. A crankshaft, not shown, is located in a vertical position and rotatably supported by the crankcase 102. The crankshaft has a gear with which the camshaft gear 107 of the camshaft 106 is in meshing engagement. A lubricant collects in the crankcase cover 103.

A cylinder head block 110 is bolted to a forward end face (right end face in FIG. 3) of the cylinder block 101 as indicated at 112, and a rocker arm cover 111 is bolted to a forward end face (right end face in FIG. 3) of the cylinder head block 110 as indicated at 114.

The cylinder block 101 and cylinder head block 110 are formed therein with push rod receiving bores 115 and 116 extending through the two blocks 101 and 110 in such a manner that one is disposed above the other and they are separated by a partition wall. The two push rod receiving bores 115 and 116 are formed by using a core when the cylinder block 101 and cylinder head block 110 are cast in a mold.

The push rod receiving bores 115 and 116 are maintained at their right ends (as seen in FIG. 3) in communication with a rocker arm chamber 117. The push rod receiving bore 115 above the push rod receiving bore 116 is formed at an upper wall near its left end portion (as seen in FIG. 3) close to the camshaft 106 with a breather port 119 through which the push rod receiving bore 115 is maintained in communication with a breather chamber 120 which is maintained in communication with an air cleaner, not shown, via a pipe 120A, for example. The breather port 119 has a check valve 121 mounted therein which allows oil mist (breather gas) or air to flow only from the push rod receiving bore 115 into the breather chamber 120.

The push rod receiving bore 116 located below the push rod receiving bore 115 is maintained through a gap at a lower portion of its end portion near the camshaft 106 in communication with the crank chamber 105, and an inner surface 116A of a lower wall of the push rod receiving bore 116 is disposed at a level slightly lower than that of an inner surface 117A of a lower wall of the rocker arm chamber 117. More specifically, the inner surface 117A of the lower wall of the rocker arm chamber 117 is slightly sloping downwardly in going toward the camshaft 106, and a portion of the inner surface 116A of the lower wall of the push rod receiving bore 116 which is disposed in the cylinder head block 110 is at the same height at its right end edge with the left end edge of the inner surface 117A of the lower wall of the rocker arm chamber 117 and slightly slopes downwardly in going toward the camshaft 106. A portion of the inner surface 116A of the lower wall of the push rod receiving bore 116 which is disposed in the cylinder block 101 is substantially horizontal and disposed at the same level as the left end edge of the portion of the inner surface 116A of the lower wall of the push rod receiving bore 116 disposed in the cylinder head block 110.

Inserted and arranged horizontally in the push rod receiving bore 115 disposed above the push rod receiving bore 116 is a suction valve actuating push rod 123 which engages, at its end disposed near the camshaft 106, a tappet 124 which is supported for axial movement by a tappet guide portion 101A and positioned against a suction valve actuating cam 106A of the camshaft 106. An end portion of the push rod 123 disposed in the rocker arm chamber 117 engages one end portion of a suction valve rocker arm 125.

Inserted and arranged horizontally in the push rod receiving bore 126 disposed below the push rod receiving bore 115 is a discharge valve actuating push rod 127 which engages, at its end disposed near the camshaft 106, a tappet 128 which is supported for axial movement by the tappet guide portion 101A and positioned against a discharge valve actuating cam 106B of the camshaft 106. An end portion of the push rod 127 disposed in the rocker arm chamber 117 engages one end portion of a discharge valve rocker arm 130.

Figure 4:
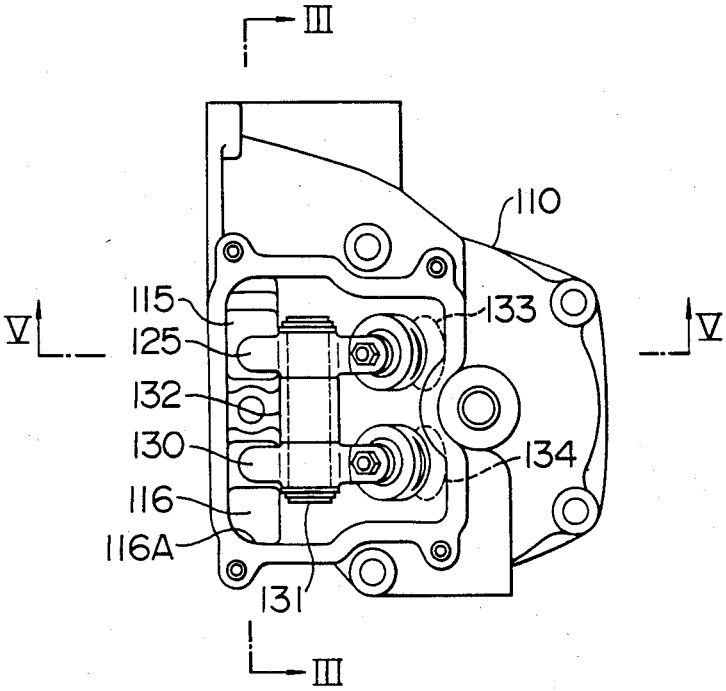
FIG. 4 is a view as seen in the direction of an arrow IV in FIG. 3, with the rocker arm cover being removed.

Referring to FIG. 4, the suction and discharge valve rocker arm 125 and 130 are pivotally supported by a rocker arm shaft 131 and engages, at their opposite end portions, a suction valve 133 and a discharge valve 134, respectively. The rocker arm shaft 131 is secured to a bearing 132 which is integral with the cylinder head block 110. As can be clearly seen in FIG. 4, the push rod receiving bores 115 and 116 are located in a position which is outside of a cooling water jacket and the end portion of the push rod receiving bore 116 below the push rod receiving bore 115 is disposed at the lowest level. Thus, the end portion of the inner surface 117A of the lower wall of the rocker arm chamber 117 disposed near the inner surface 116A of the lower wall of the push rod receiving bore 116 is at the lowest level as shown in FIG. 3.

Figure 5:
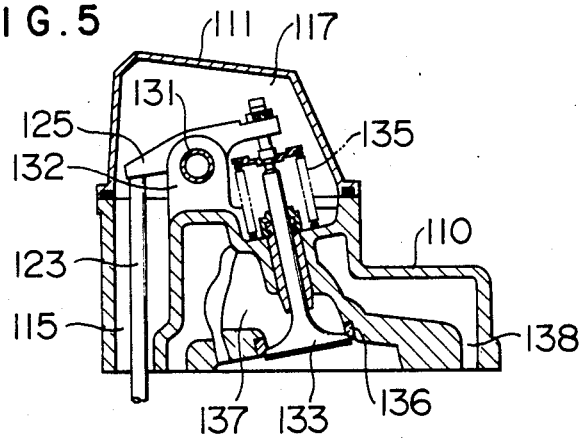
FIG. 5 is a sectional view taken along the line V—V in FIG. 4.

Referring to FIG. 5, the intake valve rocker arm 125 is positioned at its forward end against the forward end portion of the exhaust valve 133 which is urged by a valve spring 135 into engagement with a valve seat 136. The numerals 137 and 138 designate a suction passageway and a cooling water jacket respectively. The cooling water jacket 138 encloses the suction passageway 137 and an exhaust passageway, not shown, and is maintained in communication with a cooling water jacket of the cylinder block 101.

Operation of the embodiment shown in FIGS. 3, 4 and 5 will be described. The oil mist produced in the crank chamber 105 is led through the lower push rod receiving bore 116 to the rocker arm chamber 117 to lubricate the rocker arms 125 and 130. Oil in a liquid state separated from gas in the rocker arm chamber 117 and collecting on the inner surface 117A of the lower wall of the rocker arm chamber 117 flows along the inner surface 117A of the lower wall of the rocker arm chamber 117 and the inner wall surface 116A of the lower wall of the push rod receiving bore 116 toward the camshaft 106, to be returned to the crank chamber 105.

The push rod receiving bore 116 is sufficiently large in cross-sectional area to allow the oil mist (breather gas) to flow therethrough from the crank chamber 105 toward the rocker arm chamber 117 without the risk that the oil in the liquid state returning from the rocker arm chamber 117 to the crank chamber 105 along the inner surface 116A of the lower wall of the push rod receiving bore 116 might be aroused to turn to oil mist again by the action of the oil mist.

When the pressure in the rocker arm chamber 117 rises, a portion of the oil mist is led from the upper push rod receiving bore 115 through the breather port 119 and check valve 121 and flows to the air cleaner.

The rocker arm chamber 117 is greater in volume than the corresponding part in the OHV engine of the prior art, thereby promoting separation of oil from gas.

In the embodiment shown in FIGS. 3, 4 and 5 and described hereinabove, the suction valve 133 is disposed above the discharge valve 134. However, the invention is not limited to this specific arrangement of the suction and discharge valves 133 and 134, and the invention can have application in an OHV engine of the vertical type in which the discharge valve is disposed above the suction valve.

In the embodiment shown in FIGS. 3, 4 and 5, the push rod receiving bores disposed one above the other are formed in the cylinder block and cylinder head block and maintained in communication with the rocker arm chamber; the inner surface of the lower wall of the lower push rod receiving bore is disposed at a level substantially equal to or lower than the inner surface of the lower wall of the rocker arm chamber; and the end portion of the lower push rod receiving bore near the camshaft is maintained at its lower portion in communication with the crank chamber. The embodiment of the aforesaid construction offers the following advantages:

(1) The need to provide a separate return oil passageway from the rocker arm chamber to the crank chamber by machining is eliminated because the lower push rod receiving bore concurrently serves as a return oil passageway. Thus, the return oil passageway can be formed when the cylinder block and cylinder head block are cast by molding, thereby facilitating the production of cylinder block and cylinder head block and reducing expenses for the production.

(2) The lower push rod receiving bore also serves concurrently as a passageway for a flow of oil mist (breather gas) from the crank chamber to the rocker arm chamber. The cross-sectional area of the lower push rod receiving bore is sufficiently large as an oil mist passageway to keep the flow velocity of the gas in the bore at a low level, to thereby eliminate the risk that the oil flowing along the inner surface of the lower wall of the push rod receiving bore might be aroused to turn to oil mist again by the action of the gas. Stated differently, the flow of breather gas from the crank chamber to the rocker arm chamber and the flow of return oil from the rocker arm chamber to the crank chamber can be kept smooth without mutual interference.

(3) The core used for forming the push rod receiving bores when the cylinder block and cylinder head block are cast by molding is large in thickness, thereby prolonging the service life of the molds for performing the casting operation.

(4) The need to provide a large thickness portion for the oil passageway in the vicinity of the combustion chamber is eliminated. This is conducive to simplification of the construction of the cooling fins and cooling water jackets and increased ease with which the cylinder block and cylinder head block are produced.

By increasing the volume of the rocker arm chamber when the push rod receiving bores are formed as shown, it is possible to further increase the efficiency with which gas/liquid separation (oil/gas separation) is effected in the rocker arm chamber.

What is claimed is:

1. An overhead valve engine comprising:

a plurality of push rod receiving bores, at least one of said push rod receiving bores being maintained in communication at one end thereof with a crank chamber and at an opposite end thereof with a rocker arm chamber and at least one other push rod receiving bore being maintained in communication with the rocker arm chamber;

a plurality of push rods contained within said plurality of push rod receiving bores; and a breather chamber in communication with said at least one other push rod receiving bore in the vicinity of a camshaft.

2. An overhead valve engine as claimed in claim 1 wherein said plurality of push rod receiving bores are arranged one above the other, and said breather chamber is communicated with the upper push rod receiving bore.

3. An overhead valve engine as claimed in claim 2 wherein an inner surface of a lower wall of the lower push rod receiving bore is disposed at a level substantially equal to or lower than an inner surface of a lower wall of the rocker arm chamber, and an end portion thereof in communication with the crank chamber.

4. An overhead valve engine as claimed in claim 1 wherein said breather chamber communicates with said at least one other push rod receiving bore through a port, which port includes a check valve.

5. An overhead valve V-type engine having a camshaft localed in a V-bank comprising:

a plurality of push rod receiving bores, at least one of said push rod receiving bores being maintained in communication at one end thereof with a crank chamber and at an opposite end thereof with a rocker arm chamber and at least one other push rod receiving bore being maintained in communication with the rocker arm chamber;

a plurality of push rods contained within said plurality of push rod receiving bores; and a breather chamber in communication with said at least one other push rod receiving bore in the vicinity of a camshaft, said breather chamber being formed integrally with a crankcase and located in a space defined by the V-bank at one side of a camshaft gear of the camshaft.

6. An overhead valve V-type engine as claimed in claim 5 wherein said breather chamber communicates with said other push rod receiving bore through a port, which port includes a check valve.

* * * * *